US007730913B2

(12) United States Patent
Voorhies et al.

(10) Patent No.: US 7,730,913 B2
(45) Date of Patent: Jun. 8, 2010

(54) INFLATION NEEDLE

(75) Inventors: Patricia C. Voorhies, Newton, MA (US); Daniel R. Marlowe, P.O. Box 8207, Santa Fe, NM (US) 87504

(73) Assignees: Patricia Coughlan Voorhies, Newton, MA (US); Daniel R. Marlowe, Sante Fe, NM (US)

( * ) Notice: Subject to any disclaimer, the term of this patent is extended or adjusted under 35 U.S.C. 154(b) by 1002 days.

(21) Appl. No.: 11/452,572

(22) Filed: Jun. 14, 2006

(65) Prior Publication Data

US 2008/0092985 A1 Apr. 24, 2008

(51) Int. Cl.
*B65B 1/04* (2006.01)

(52) U.S. Cl. ..... 141/329; 141/114; 141/313; 137/231

(58) Field of Classification Search ..... 141/77, 141/98, 114, 313, 311 R, 384, 329, 383; 137/231, 137/223; 152/415
See application file for complete search history.

(56) References Cited

U.S. PATENT DOCUMENTS

| | | | | |
|---|---|---|---|---|
| 534,881 | A | | 2/1895 | Hearne et al. |
| 556,777 | A | | 3/1896 | Savoie |
| 575,430 | A | | 1/1897 | Savoie |
| 615,670 | A | | 12/1898 | Blair |
| 3,484,849 | A | | 12/1969 | Huebner et al. |
| 3,933,177 | A | * | 1/1976 | Dwyer, Jr. ..... 137/861 |
| 3,941,171 | A | | 3/1976 | Ogle |
| 4,043,356 | A | | 8/1977 | Morris et al. |
| 4,153,096 | A | | 5/1979 | Kirk |
| 5,241,981 | A | | 9/1993 | Ahern |
| 5,245,991 | A | | 9/1993 | Kawaguchi |
| 5,556,258 | A | | 9/1996 | Lange et al. |
| 5,746,243 | A | | 5/1998 | Franke |
| D406,267 | S | | 3/1999 | Carter |
| D433,101 | S | | 10/2000 | Chern |
| 6,173,928 | B1 | | 1/2001 | Coats |
| D460,704 | S | | 7/2002 | Peele |
| 6,923,222 | B2 | | 8/2005 | Gaines |
| 2003/0178092 | A1 | | 9/2003 | Birmingham |

* cited by examiner

*Primary Examiner*—Gregory L Huson
*Assistant Examiner*—Jason K Niesz
(74) *Attorney, Agent, or Firm*—Sampson & Associates P.C.

(57) ABSTRACT

An inflation needle for inflating an object such as a sports ball includes a tubular body having an attachment end configured for engagement with a fluid supply. The body fairs into a tubular probe extending along a longitudinal axis from a proximal end to a distal end configured for being inserted into the ball. A concavo-convex base extends radially outward from the body and towards the distal end, terminating at a periphery spaced radially from the probe, the base being configured to engage the object upon insertion of the probe therein. The inflation needle is a unitary, molded polymeric component.

25 Claims, 4 Drawing Sheets

INFLATION NEEDLE

BACKGROUND

1. Technical Field

This invention relates to inflation needles, and more particularly to needles for inflating sports balls and the like.

2. Background Information

Throughout this application, various publications, patents and published patent applications are referred to by an identifying citation. The disclosures of the publications, patents and published patent applications referenced in this application are hereby incorporated by reference into the present disclosure.

Traditional inflation needles for sports balls and like include relatively long, thin hollow metallic probes configured to be axially inserted into the bung of the ball. While these needles may be reasonably effective in many applications, they have been found to be relatively delicate and subject to bending and breakage during use. Such breakage is at best inconvenient, requiring a user to remove the broken pieces from a pump and/or ball, and to begin the inflation process again with a new inflation needle. Such breakage also runs the risk, however, of the severed probe tip becoming lodged within the bung, where it may become difficult if not impossible to remove without damaging the ball.

Examples of various inflation needles include that disclosed by Gaines in U.S. Pat. No. 6,923,222, which is a conventional inflating needle of the type commonly employed for inflating sports balls.

Morris et al. (U.S. Pat. No. 4,043,356) disclose an inflator probe for filling gas containers, which includes a one-piece body molded from a plastic material and providing a cylindrical externally threaded end piece for attachment to a pump followed by an enlarged-diameter shoulder having finger grips and an elongated tapered nozzle extending therefrom.

Blair (U.S. Pat. No. 615,670) discloses a multiple component inflating nipple which includes a tapered shank threadably engaged with a nut captured at an end of a cup. The relatively narrow cup axially supports the shank as the nut is rotated to effect insertion.

None of these references disclose or address the problem of needle breakage during use. A need, therefore, exists for an improved inflation needle which addresses drawbacks of the prior art.

SUMMARY

In one aspect of the invention, an inflation needle, includes a tubular body having an attachment end configured for engagement with an air pump. The body fairs into a tubular probe extending along a longitudinal axis from a proximal end to a distal end which is configured for being inserted into an object to be inflated. A concavo-convex base extends radially outward from the body and towards the distal end, and terminates at a periphery spaced radially from the tubular probe, and which is configured to engage the object upon insertion of the probe therein. The periphery defines a transverse dimension of the base, and the probe defines an axial dimension extending from the periphery to the distal end, and a ratio of the transverse dimension to the axial dimension is at least 0.5:1. The inflation needle is a unitary, molded polymeric component.

In another aspect of the invention, an inflation needle includes a tubular body having an attachment end configured to be engaged with a fluid supply. The body fairs into a tubular probe extending along a longitudinal axis from a proximal end to a distal end configured for being inserted into an object to be inflated. A concavo-convex base extends radially outward from the body and towards the distal end, terminating at a periphery spaced radially from the tubular probe, the base being configured to engage the object upon insertion of the probe therein. The inflation needle is a unitary, molded polymeric component.

In still another aspect of the invention, a method for manufacturing an inflation needle includes providing a tubular body having an attachment end configured to be engaged with a fluid supply, and fairing the body into a tubular probe extending along a longitudinal axis from a proximal end to a distal end configured for being inserted into an object to be inflated. A base is extended radially outward from the body and towards the distal end, terminating at a periphery spaced radially from the tubular probe, so that the base has a substantially concave surface facing the distal end, the base being configured to engage the object upon insertion of the probe therein. The inflation needle is molded as a unitary, polymeric component.

BRIEF DESCRIPTION OF THE DRAWINGS

The above and other features and advantages of this invention will be more readily apparent from a reading of the following detailed description of various aspects of the invention taken in conjunction with the accompanying drawings, in which.

DETAILED DESCRIPTION

Figure 1:
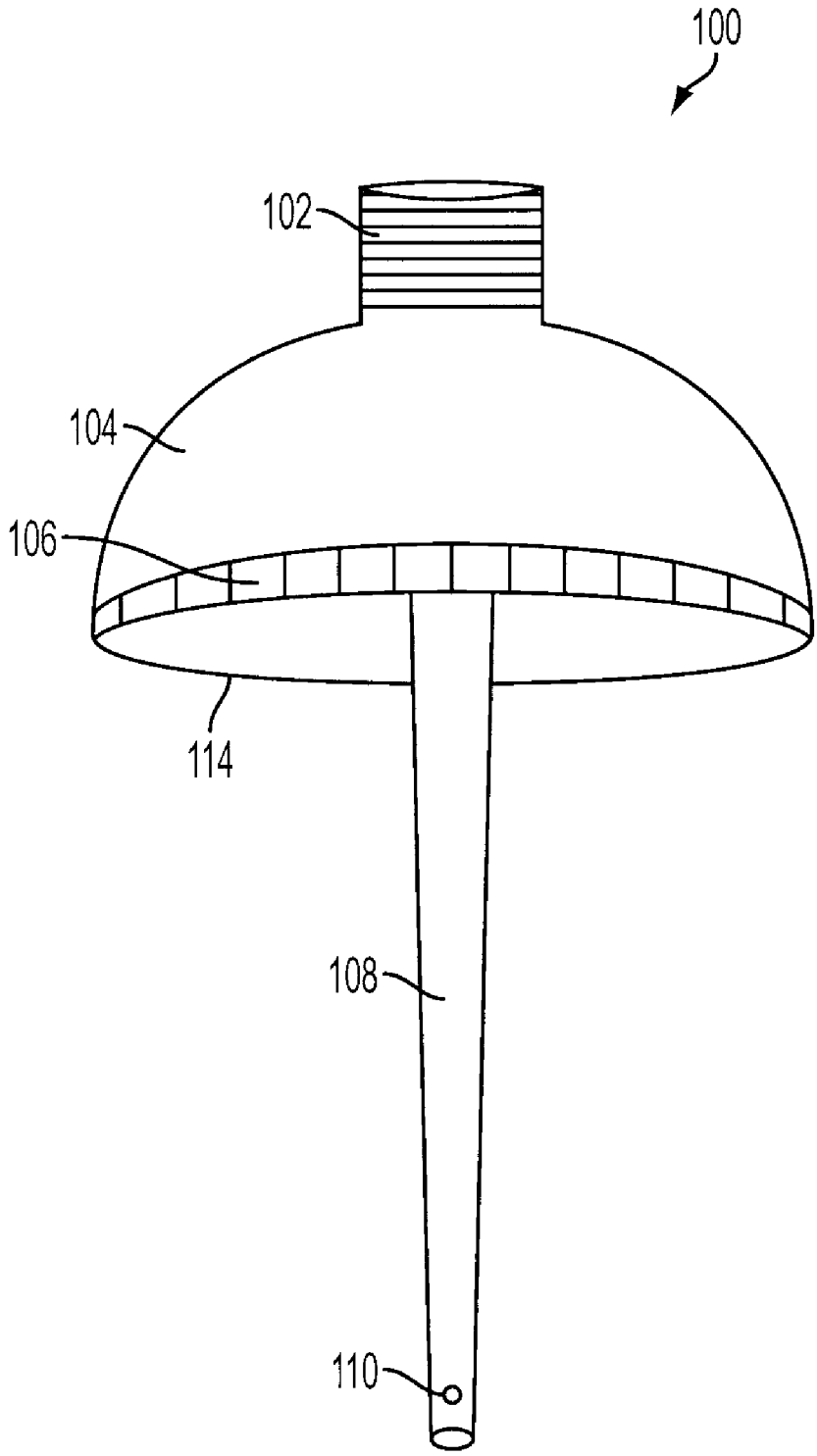
FIG. 1 is a perspective view of an embodiment of the subject invention.

In the following detailed description, reference is made to the accompanying drawings that form a part hereof, and in which is shown by way of illustration, specific embodiments in which the invention may be practiced. These embodiments are described in sufficient detail to enable those skilled in the art to practice the invention, and it is to be understood that other embodiments may be utilized. It is also to be understood that structural, procedural and system changes may be made without departing from the spirit and scope of the present invention. The following detailed description is, therefore, not to be taken in a limiting sense, and the scope of the present invention is defined by the appended claims and their equivalents. For clarity of exposition, like features shown in the accompanying drawings shall be indicated with like reference numerals and similar features as shown in alternate embodiments in the drawings shall be indicated with similar reference numerals.

Where used in this disclosure, the term "axial" when used in connection with an element described herein, refers to a direction substantially parallel to the insertion direction of the needle. The term "transverse" refers to a direction other than (e.g., substantially orthogonal) to the axial direction. The term "fluid" is used in its conventional sense, to refer to gases such as air, and liquids.

It was discovered by the instant inventors that prior art inflation needles tended to break due to the relatively high transverse (shear) forces to which the needles were often subjected during use. It was found that it is often difficult to insert the probe and inflate the ball without accidentally pushing the probe sideways, i.e., transversely to the insertion direction. Conditions of the sports field and use by children tend to be particularly conducive to rough handling of the needle. Also, the rounded surfaces of various sports balls make them particularly likely to roll as pressure is applied to the needle to insert and/or maintain secure engagement with a pump, which may serve to apply a transverse, bending moment to the needle. This bending moment, due to the needle's relatively small transverse dimension and thin tubular walls, has been found to often result in fractures or breaks therein. It was hypothesized that by providing a means to oppose these transverse forces, the needle would be better able to resist such breakage.

Embodiments of the present invention include an inflation needle having a probe and a flange or base which would engage the curved surface of a ball, etc., upon insertion of the probe. In the event the probe is pushed in a sideways direction during insertion or inflation, this movement would be opposed by engagement of the flange with the ball. In addition, the compression force associated with continued pressure applied to the needle, such as to maintain connection with the pump during inflation, may be distributed over the wider cross sectional area of the flange, rather than being concentrated on the narrower probe. In particular embodiments, the base is substantially concavo-convex, with a generally concave surface facing the ball, to enable its periphery to engage the rounded surface of the ball. In particular embodiments, the concavo-convex base is cylindrical or frusto-conical.

Figure 4:
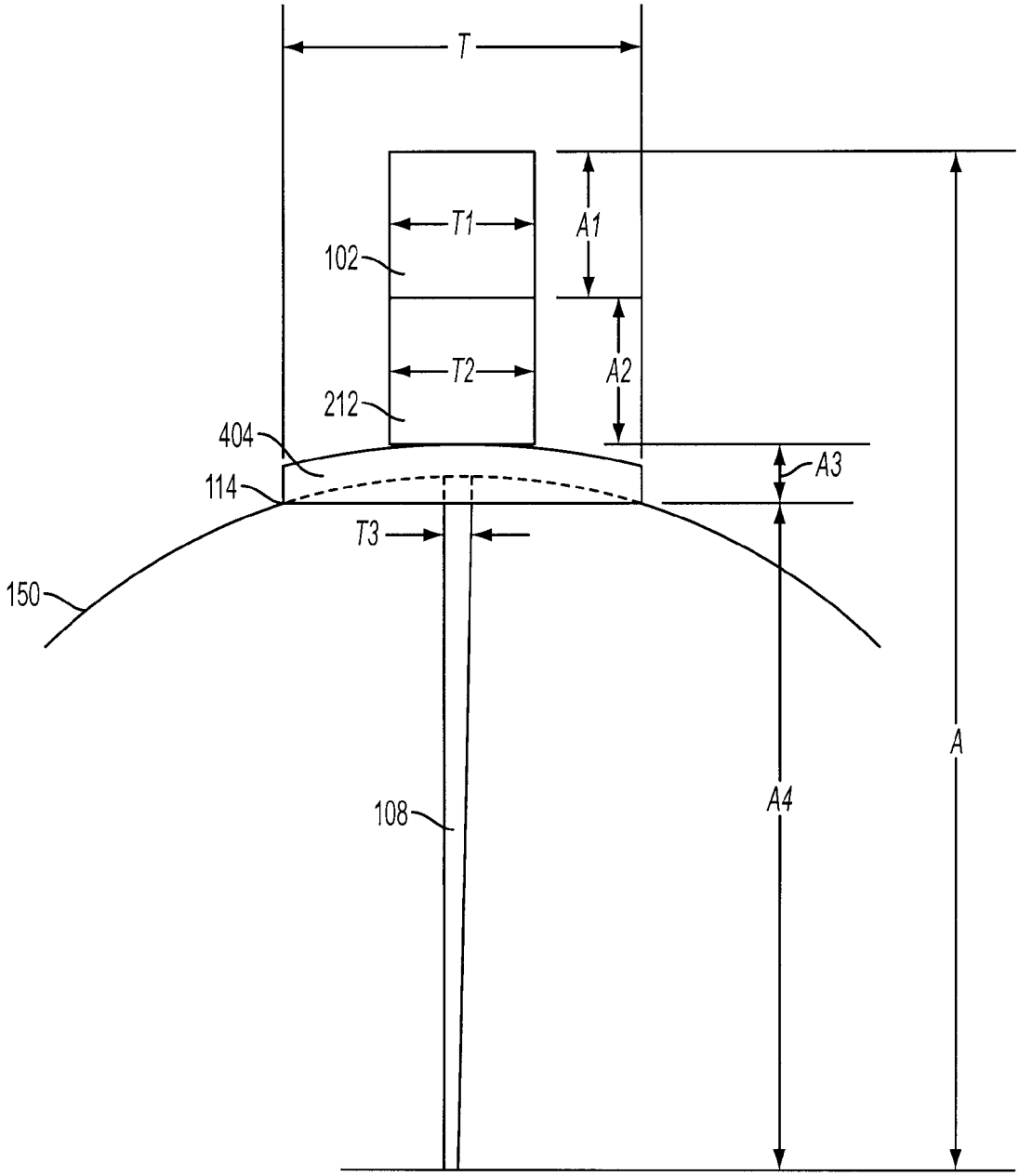
FIG. 4 is an elevational view of still another embodiment of the subject invention shown in engagement with a portion of an object to be inflated.

Referring now the Figures, embodiments of the invention will be described in greater detail. Turning to FIG. 1, an inflation needle 100 has a concavo-convex base 104 which, upon full insertion of the probe 108, engages the surface of the object to be inflated, such as the spherical surface of a sports ball. The skilled artisan, upon review of the instant disclosure, will recognize that the substantially concave inner configuration of base 104 enables it to engage a substantially convex surface (e.g., of a ball), at a point spaced transversely from probe 108. Indeed, as best shown in FIG. 4, the concavo-convex structure of the various base configurations enables them to engage the convex surface 150 of a ball, along their peripheries 114. This relatively widely spaced engagement provides a relatively large moment arm to counteract any bending moment inadvertently applied by the user as discussed above.

An attachment end 102 is configured to be coupled to a pump or other supply of air (e.g., compressor or other compressed gas supply) or other fluid suitable to the particular application. In the embodiment shown, the attachment end 102 is threaded or knurled to facilitate attachment to a fluid supply. Those skilled in the art will recognize that attachment end 102 may be provided with nominally any other type of fitting to facilitate fluid connection.

The base 104 may include a scored edge 106, allowing an improved grip for a user grasping the base 104 during handling, such as while coupling the attachment end 102 to the fluid supply and/or inserting the needle into the ball. The needle 100 is tubular/hollow and includes at least one hole 110 near the distal (insertion) end, to allow the fluid to flow therethrough in a conventional manner. In alternate embodiments, the insertion end of the probe 108 may comprise two or more holes 110.

In particular embodiments, the needle 100 is fabricated from a moldable polymeric material, such as a high density or reinforced plastic. Selection of particular polymeric materials may enable the probe 108 thereof to be more resilient and less susceptible to breakage than a traditional metallic needle. Examples of suitable materials include but are not limited to polyamide (NYLON® DuPont), thermoplastics, or engineered resins, such as sulfone polymers, polypropylene, polyethylene, polyesters, polycarbonate, polyurethane, acrylonitrile-butediene-styrene (ABS), styrene-acrylonitile (SAN), or fiberglass. Fabrication of the needle from these polymers, particularly when using conventional high-volume approaches such as injection molding, may reduce manufacturing costs and/or complexities relative to traditional multiple-component metallic needles.

Figure 2:
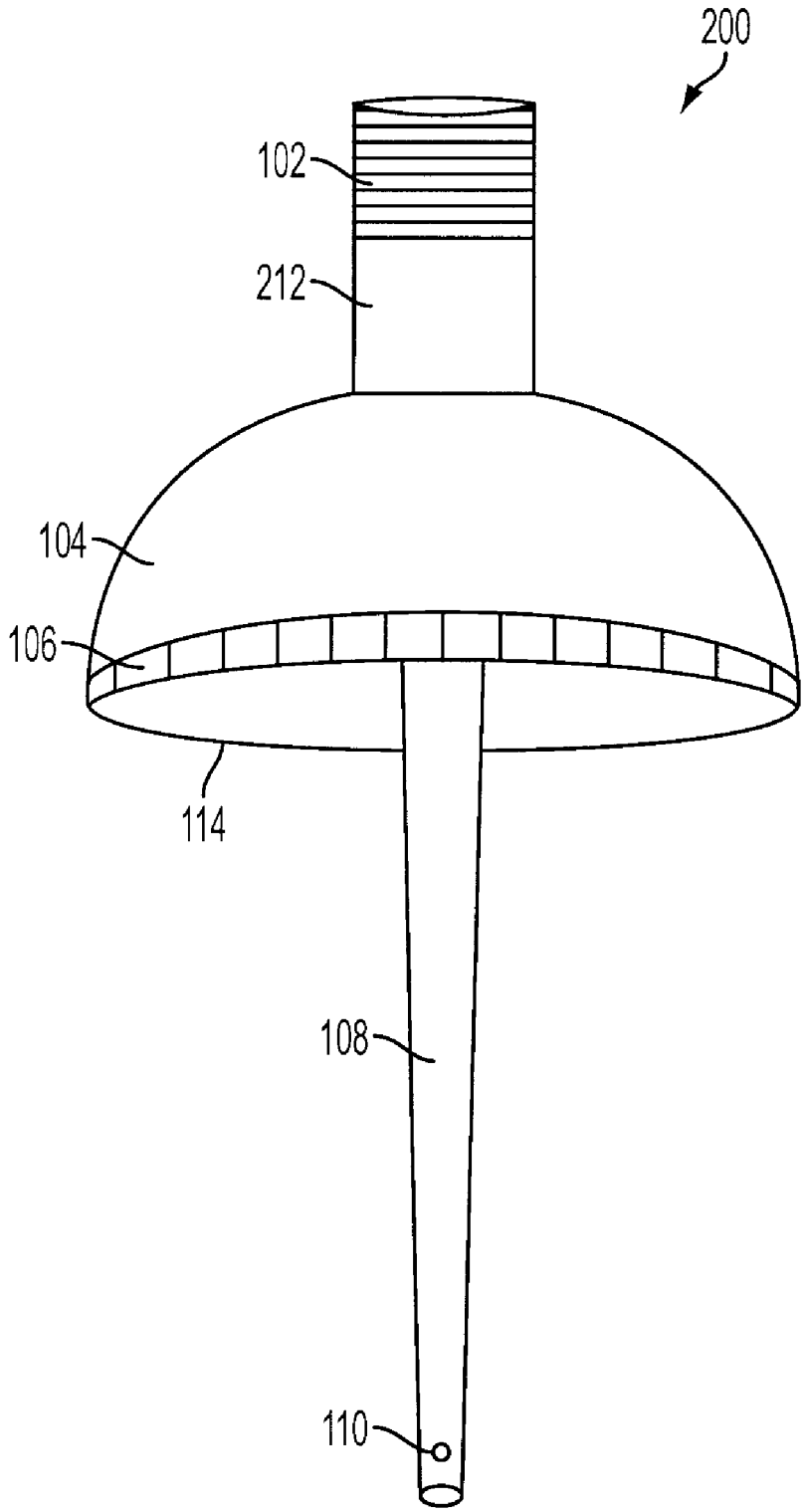
FIG. 2 is a perspective view of an alternate embodiment of the subject invention.

In an alternate embodiment, the inflation needle may include a stem, such as to provide improved grip for a user. Referring to FIG. 2, needle 200 includes a stem 212 disposed between base 104 and attachment end 102. A stem may be used with bases of nominally any desired shape, such as the frusto-conical base 304 of FIG. 3. As shown, stem 212 optionally has grooved, striated sides to allow better gripping during use. As also shown, in particular embodiments, the exterior transverse dimension of stem 212 is approximately equal to the exterior dimension of attachment end 102, as will be discussed in greater detail hereinbelow with respect to FIG. 4.

Figure 3:
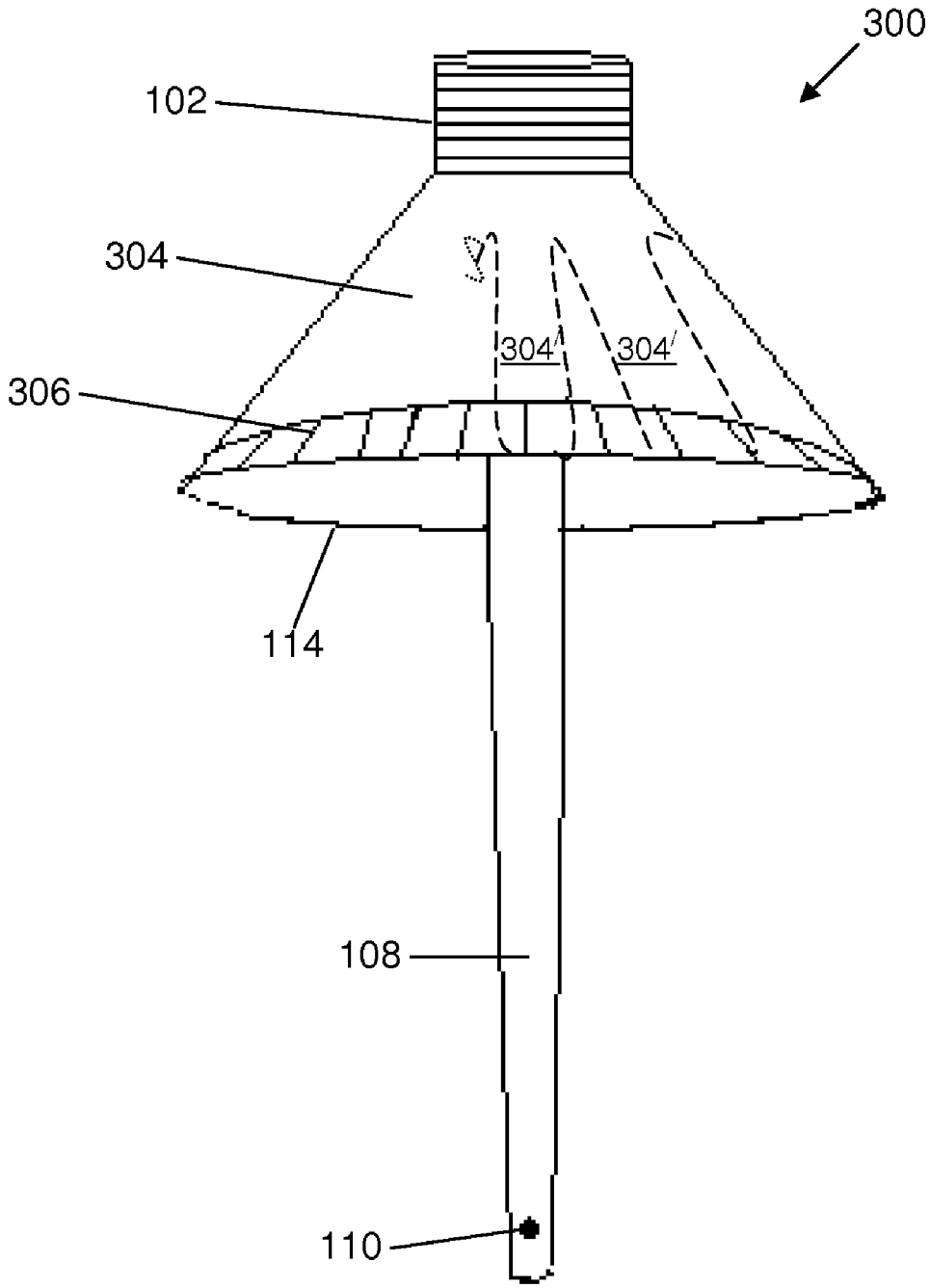
FIG. 3 is a perspective view of another alternate embodiment of the subject invention.

As shown in FIG. 3, needle 300 includes a concavo-convex base 304 which is substantially frusto-conical. Base 304 is also shown with an optional scored edge 306 for improved grip by the user.

Turning now to FIG. 4, embodiments of the present invention may be provided with a wide range of dimensions suitable for any of various inflation applications. For many applications, base 104, 304, 404 is provided with an exterior transverse dimension T, and probe 108 is provided with an axial dimension A4, configured to provide a ratio T:A4 which is at least 0.5:1, and which may be as high as about 1:1 or more in some embodiments. This ratio provides a transverse dimension T that is substantially larger than the transverse dimension T3 of probe 108. As discussed hereinabove, this relatively large dimension T, in combination with the inner concave configuration of the base, engages a surface 150 of an object to be inflated at a relatively large distance from probe 108. As discussed hereinabove, this large distance provides a relatively large moment arm that effectively opposes typical transverse forces applied to probe 108 during insertion and/or use. As also discussed, this relatively large distance also defines a relatively large cross-sectional area that tends to distribute any axial forces that may continue to be applied upon full insertion of the needle.

Although concavo-convex base 104, has been shown and described as being substantially semi-spherical, and base 304 has been shown as being frusto-conical, substantially any concavo-convex shape may be used, such as a cylindrical, box, dome shape, a series of spaced fingers, or other more complex concavo-convex configurations. Nominally any concavo-convex configuration may be used, which provides a concave surface facing the distal (insertion) end, to facilitate with a curved surface of the object to be inflated. In addition, while peripheries 114 are shown and described as being substantially circular, it should be understood that the various concavo-convex base configurations described herein may effectively form peripheries of nominally any configuration, including various polygonal or spoked configurations that may or may not provide an uninterrupted or continuous engagement with surface 150. Rather, nominally any periphery configuration may be used, as long as it is capable of engaging a convex surface 150 at least two, and preferably at least three locations spaced radially about the axis of probe 108 upon insertion thereof. For example, a concavo-convex base may be fabricated as a series of fingers 304' spaced about probe 108, as shown in phantom in FIG. 3, which may engage the surface of a ball at their tips.

As also shown, representative embodiments of probe 108 are provided with an axial dimension A4 which may be within a range of about 30 mm to about 50 mm, and in particular embodiments, 35 mm to about 45 mm. Base 104, 304, 404, etc., has an axial dimension A3 which may be within a range of about 2 mm to about 6 mm, and in particular embodiments, about 3 mm to about 5 mm. Attachment end 102 and optional stem 212 (FIG. 2) have axial dimensions A1 and A2 respectively, which are each within a range of about 5 mm to about 10 mm, or about 7 mm to about 9 mm in some embodiments. These embodiments may thus be provided with an overall axial dimension A within a range of about 40 mm to about 80 mm, and in particular embodiments, about 55 mm to about 65 mm.

Attachment end 102 and optional stem 212 are provided with transverse dimensions T1 and T2 which may both be within a range of about 5 mm to about 10 mm in some embodiments, and within a range of about 8-9 mm in others. Base 104, 304, 404, etc., has an exterior transverse dimension T which may be within a range of about 15 mm to about 25 mm in various embodiments, and in particular embodiments, within a range of about 21 mm to about 23 mm. Exterior transverse dimension T3 of probe 108 may be within a range of about 1 mm to about 4 mm in various embodiments, or about 2 mm to about 3 mm in other embodiments.

The following illustrative example is intended to demonstrate certain aspects of the present invention. It is to be understood that this example should not be construed as limiting.

Example

An inflation needle substantially as shown and described in FIG. 4 is injection molded as a single, unitary component, from a polymeric material. The needle includes a base 404 having an exterior transverse dimension T of about 22 mm, and a probe 108 having an axial dimension A4 of about 40 mm, for a ratio T:A4 of about 0.5:1.

Attachment end 102 and stem 212 both have axial dimensions A1 and A2, respectively, of about 8 mm. Base 404 has an axial dimension A3 of about 4 mm, to provide a total length A of about 60 mm.

Attachment end 102 and stem 212 have respective transverse dimensions T1 and T2 of about 8-9 mm. Probe 108 has an exterior transverse dimension T3 of about 2 mm.

In the preceding specification, the invention has been described with reference to specific exemplary embodiments thereof. It will be evident that various modifications and changes may be made thereunto without departing from the broader spirit and scope of the invention as set forth in the claims that follow. The specification and drawings are accordingly to be regarded in an illustrative rather than restrictive sense.

Having thus described the invention, what is claimed is:

1. An inflation needle, comprising:

a tubular body having an attachment end configured for engagement with an air pump;

said body fairing into a tubular probe extending along a longitudinal axis from a proximal end to a distal end;

said distal end configured for being inserted into an object to be inflated;

a concavo-convex base extending radially outward from said body and towards said distal end, terminating at a periphery spaced radially from said tubular probe;

wherein said base is configured to absorb lateral forces;

said periphery configured to engage an external surface of the object upon insertion of said probe therein;

wherein said periphery defines a transverse dimension of said base, and said probe defines an axial dimension extending from said periphery and away from said proximal end, to said distal end, and a ratio of said transverse dimension to said axial dimension is at least 0.5:1; and said inflation needle is a unitary, molded polymeric component.

2. An inflation needle, comprising:

a tubular body having an attachment end configured to be engaged with a fluid supply;

said body fairing into a tubular probe extending along a longitudinal axis from a proximal end to a distal end;

said distal end configured for being inserted into an object to be inflated;

a concavo-convex base extending radially outward from said body and towards said distal end, terminating at a periphery spaced radially from said probe;

wherein said base is configured to absorb lateral forces;

wherein said probe defines an axial dimension extending from said periphery and away from said proximal end, to said distal end;

said base configured to engage an external surface of the object upon insertion of said probe therein; and said inflation needle being a unitary, molded polymeric component.

3. The inflation needle of claim 2, wherein said base has a scored surface portion.

4. The inflation needle of claim 2, wherein said attachment end has a threaded surface.

5. The inflation needle of claim 2, wherein said attachment end is knurled.

6. The inflation needle of claim 2, wherein said fluid supply is an air pump.

7. The inflation needle of claim 2, wherein said object to be inflated is a sports ball.

8. The inflation needle of claim 2, further comprising a stem disposed between said attachment end and said base.

9. The inflation needle of claim 8, wherein said stem is striated.

10. The inflation needle of claim 8, wherein said stem has an exterior transverse dimension equal to an exterior transverse dimension of said attachment end.

11. The inflation needle of claim 2, wherein said base is configured to engage the object along at least a portion of said periphery.

12. The inflation needle of claim 11, wherein said base is configured to engage a spherical object along substantially all of said periphery.

13. The inflation needle of claim 11, wherein said periphery is substantially circular.

14. The inflation needle of claim 11, wherein said periphery comprises a plurality of fingers spaced radially about said probe.

15. The inflation needle of claim 14, wherein said periphery is configured to engage the object at tip portions of said fingers.

16. The inflation needle of claim 2, wherein said concavo-convex base is frusto-conical.

17. The inflation needle of claim 2, wherein:

said attachment end has an axial dimension of about 5 mm to about 10 mm;

said base has an axial dimension of about 2 mm to about 6 mm;

said probe has an axial dimension of about 30 mm to about 50 mm; and said inflation needle has a total axial dimension within a range of about 40 mm to about 80 mm.

18. The inflation needle of claim 17, wherein:

said attachment end has an axial dimension of about 7 mm to about 9 mm;

said base has an axial dimension of about 3 mm to about 5 mm;

said probe has an axial dimension of about 35 mm to about 45 mm; and said inflation needle has a total axial dimension within a range of about 55 mm to about 65 mm.

19. The inflation needle of claim 2, wherein:

said attachment end has an exterior transverse dimension of about 5 mm to about 10 mm;

said base has an exterior transverse dimension of about 15 mm to about 25 mm; and said probe has an exterior transverse dimension of about 1 mm to about 4 mm.

20. The inflation needle of claim 19, wherein:

said attachment end has an exterior transverse dimension of about 8 mm to about 9 mm;

said base has an exterior transverse dimension of about 21 mm to about 23 mm; and said probe has an exterior transverse dimension of about 2 mm to about 3 mm.

21. The inflation needle of claim 2, wherein said periphery defines a transverse dimension of said base, and said probe defines an axial dimension extending from said periphery to said distal end, and a ratio of said transverse dimension to said axial dimension is at least 0.5:1.

22. The inflation needle of claim 21, wherein said ratio is at least about 1:1.

23. The inflation needle of claim 2, being fabricated from a polymer selected from the group consisting of thermoplastics, engineered resins, sulfones, polyamide, polypropylene, polyethylene, polyesters, polycarbonate, polyurethane, acrylonitrile-butadiene-styrene (ABS), styrene-acrylonitile (SAN), fiberglass, or combinations thereof.

24. A method for manufacturing an inflation needle, comprising:

(a) providing a tubular body having an attachment end configured to be engaged with a fluid supply;

(b) fairing the body into a tubular probe extending along a longitudinal axis from a proximal end to a distal end;

(c) configuring the distal end for being inserted into an object to be inflated;

(d) extending a base radially outward from the body and towards the distal end, terminating at a periphery spaced radially from said tubular probe, so that the base has a substantially concave surface facing the distal end;

wherein said base is configured to absorb lateral forces;

wherein said probe defines an axial dimension extending from said periphery and away from said proximal end, to said distal end;

(e) configuring the base to engage an external surface of the object upon insertion of said probe therein; and (f) molding the inflation needle as a unitary, polymeric component.

25. An inflation needle, comprising:

a tubular body having an attachment end configured to be engaged with a fluid supply;

said body fairing into a tubular probe extending along a longitudinal axis from a proximal end to a distal end;

said distal end configured for being inserted into an object to be inflated;

a concavo-convex base extending radially outward from said body and towards said distal end, terminating at a periphery spaced radially from said tubular probe;

wherein said base is configured to absorb lateral forces;

wherein said probe defines an axial dimension extending from said periphery and away from said proximal end, to said distal end;

said base configured to engage an external surface of the object upon insertion of said probe therein; and said inflation needle being a unitary component.

* * * * *